United States Patent [19]
Maliszewski
[11] 4,289,251
[45] Sep. 15, 1981

[54] NON-DETACH EASY OPENING CONTAINER UNIT

[75] Inventor: Leonard A. Maliszewski, Western Springs, Ill.

[73] Assignee: The Continental Group, Inc., Stamford, Conn.

[21] Appl. No.: 148,468

[22] Filed: May 9, 1980

[51] Int. Cl.³ ..... B65D 17/34
[52] U.S. Cl. ..... 220/269
[58] Field of Search ..... 220/269–273

[56] References Cited

U.S. PATENT DOCUMENTS 3,326,406 6/1967 Brown ..... 220/269
3,744,667 7/1973 Fraze et al. ..... 220/269

*Primary Examiner*—George T. Hall
*Attorney, Agent, or Firm*—Charles E. Brown

[57] ABSTRACT

This relates to an easy opening container unit wherein a panel of a container is provided with a first line of weakness defining a first displaceable panel portion which, when displaced, defines a dispensing opening in the container. A second line of weakness extends from the first line of weakness and defines a second displaceable panel portion to which an opening tab is secured with the second displaceable panel portion functioning as a hinge element for the opening tab. the arrangement of the lines of weakness permits the use of a substantially rigid tab which permits a greater leverage advantage while at the same time minimizing tab failure.

19 Claims, 6 Drawing Figures

NON-DETACH EASY OPENING CONTAINER UNIT

This invention relates in general to new and useful improvements in easy opening containers, and more specifically to an easy opening container end unit wherein the displaceable panel portion remains attached to the end unit.

This invention specifically relates to a novel beverage end unit wherein a first weakening line defines a displaceable panel portion connected to the remainder of the end panel along a first hinge line, and a second line of weakness in conjunction with the first line of weakness defines a second displaceable panel portion connected to the remainder of the end panel along a second hinge line. The second displaceable panel portion has fixedly secured thereto an opening tab, which may be longitudinally rigid, and which, when lifted in the normal manner, will effect rupture of the container panel simultaneously along both of the lines of weakness with the second displaceable panel portion and its associated hinge line forming hinge means for the opening tab.

One of the features of the invention is that the displaceable panel portion which defines the dispensing opening is elongated as compared to its width, and therefore is relatively narrow with the result that when the container is opened and the panel portion displaced into the interior of the container, the sweeping engagement thereof with the product is either eliminated or is held to a minimum.

Another feature of the invention is that a rigid opening tab may be utilized, thereby greatly reducing the possibility of tab failure.

The specific mounting of the tab also permits the use of previously conventional teardrop shaped opening panels.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
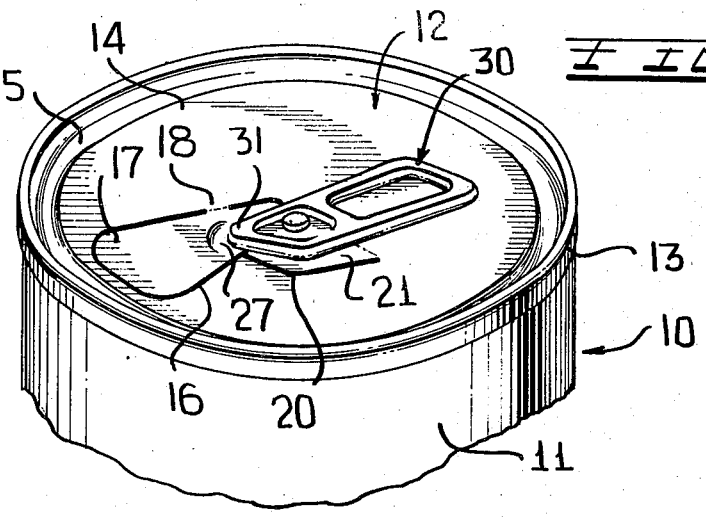
FIG. 1 is a top perspective view of an upper end portion of a can having therein an easy opening end unit in accordance with this invention.
Figure 2:
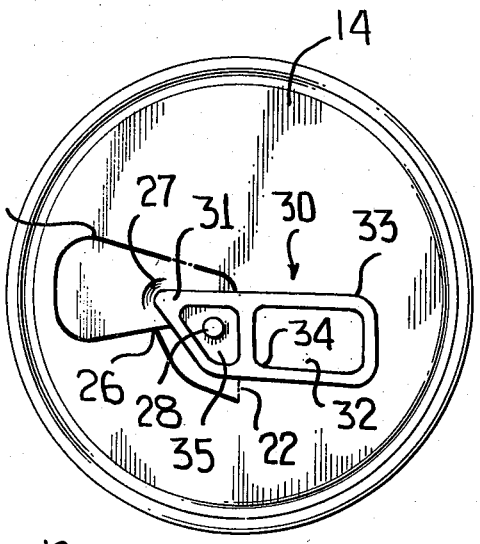
FIG. 2 is a plan view of the end unit.

Referring now to the drawings in detail, there is illustrated in FIG. 1 a can, generally identified by the numeral 10, which includes a body 11 having an illustrated end thereof closed by an easy opening end unit 12 formed in accordance with the invention. The end unit 12 is secured to the can body 11 by way of a conventional double seam 13 and includes a circular end panel 14 generally defined by a peripheral inwardly directed bead 15.

Figure 3:
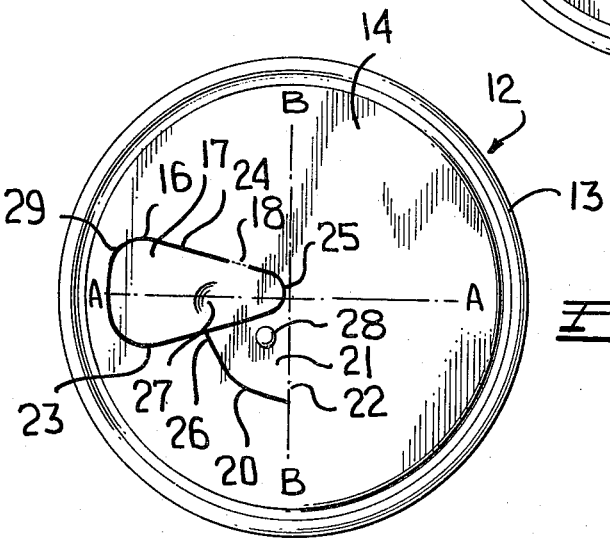
FIG. 3 is a plan view similar to FIG. 2, but with the tab omitted for the purpose of clarity.

With particular reference to FIG. 3, the end panel 14 is provided with a first line of weakness 16, preferably in the form of a score line, which outlines a first displaceable panel portion 17 which remains hingedly connected to the remainder of the end panel 14 along a first hinge line 18 when the can is in its opened condition.

The end panel 14 is provided with a second line of weakness 20, also preferably in the form of a score line, which extends from an intermediate portion of the line of weakness 16 to a position generally diametrically opposite the inner end of the panel portion 17. The line of weakness 20, together with an adjacent part of the line of weakness 16, defines a second displaceable panel portion 21 which is attached to the end panel 14 along a second hinge line 22 which is generally disposed along a second diametrical line B—B which is disposed at substantially right angles to the diametrical line A—A.

It will be seen that the displaceable panel portion 17 is generally of a teardrop configuration and includes opposite sides 23, 24 joined at their inner ends by a small radius curve 25 and at their outer ends by a generally C-shaped curved line 29 which is of a much greater extent transversely of the panel portion 17 than the curved line 25.

The first hinge line 18 is along the side 24 while the second line of weakness 20 intersects the first line of weakness 16 along the side 23 at 26. The second hinge line 22 is tangential to the line 25.

The panel portion 17 is intended to define a seat 27 while the panel portion 21 is provided with an integral rivet 28.

In accordance with this invention there is also provided an opening tab, generally identified by the numeral 30. The tab 30 is generally rectangular in outline and includes a generally triangular force applying nose 31. The rear portion of the tab 30 is open to define a finger receiving opening 32 and is reinforced by way of an outer peripheral flange 33 and an inner peripheral flange 34 surrounding the finger receiving opening 32. A forward portion of the tab 30 is in the form of a recessed panel 35 which receives the rivet 28.

One side of the tab 30 extends generally along the diametrical line A—A with the tab 30 being disposed longitudinally of the panel 17 and with the hinge line 22 extending transversely of the tab.

Referring once again to FIG. 3, it will be seen that the rivet 28 is offset relative to the center of the end panel 14 and lies generally along a center line dividing the panel 21 into symmetrical halves.

The nose 31 of the tab 30 is generally seated in a pocket or seat 27 and when lifted applies a rupturing pressure to the panel portion 17 such as to initiate rupture of the lines of weakness 16 and 20 at the intersection 26. As the tab 30 is continued to be lifted, the rupture of the end panel 14 will propagate in two directions along the line of weakness 16 and also along the line of weakness 20. As the rupture of the end panel 14 progresses, the hinge line 22 will become the hinge line for the tab 30 so that when the tab 30 is fully lifted to its position shown in FIGS. 4 and 6, it will have hinged with the panel portion 21 about the hinge line 22 into the interior of the can and will have forced the panel portion 17 into the interior of the can in depending relation along the hinge line 18. The tab is then returned to its normal position overlying the end panel leaving in the end panel primarily a teardrop shaped dispensing opening 36 through which the beverage or other liquid product may be readily dispensed.

Figure 4:
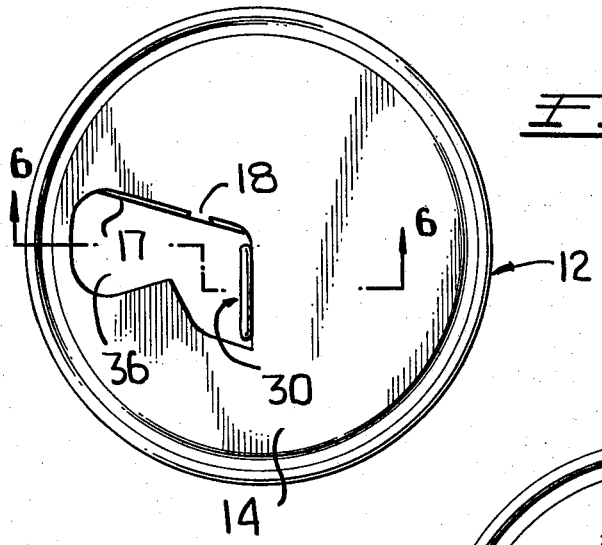
FIG. 4 is a plan view similar to FIG. 2, but with the tab in its fully elevated position and with the dispensing opening defining panel portion displaced into the interior of the can.
Figure 5:
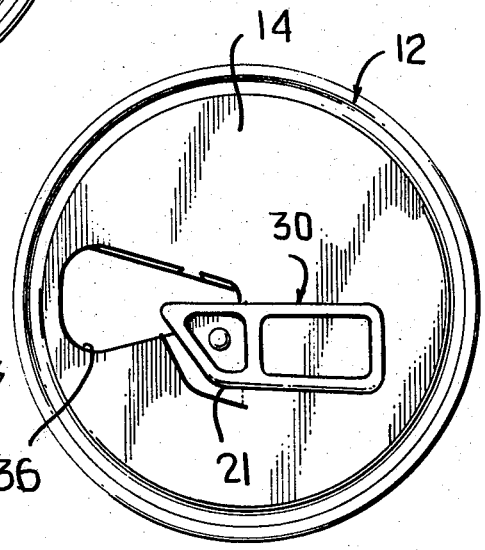
FIG. 5 is a plan view also similar to FIG. 2, but with the tab returned generally back to its starting position.
Figure 6:
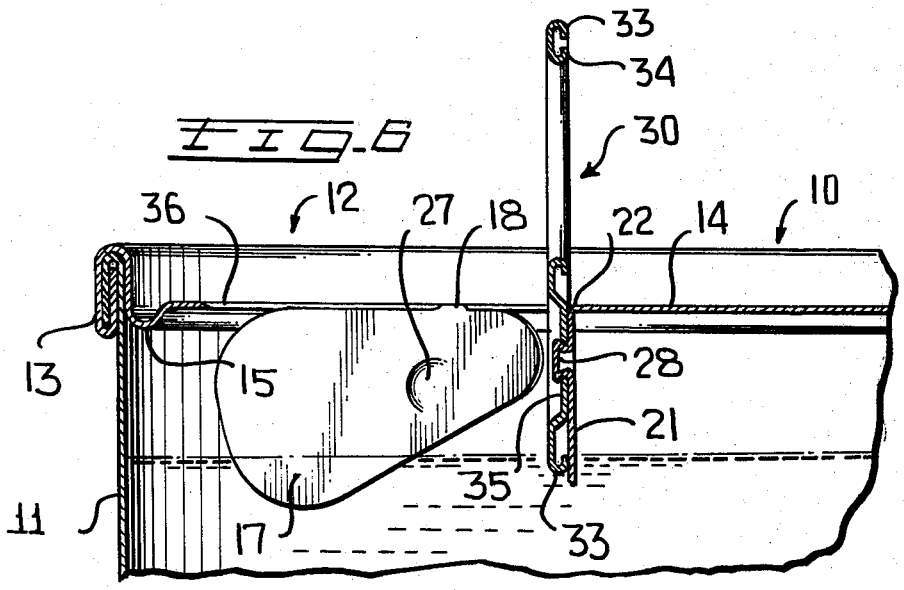
FIG. 6 is an enlarged fragmentary vertical sectional view taken generally along the line 6—6 of FIG. 4, and shows further the details of the can in its opened condition and prior to the returning of the tab to its starting position.

The present opening configuration provides for the proven commercially acceptable teardrop shaped dispensing opening. In addition, the teardrop configuration permits the displaceable panel portion 17 to be relatively narrow and thus will minimize or eliminate foaming and gushing because the panel portion 17 either will not or will only partially sweep into the product liquid level as the panel portion 17 is pushed to its position as shown in FIGS. 4 and 6.

The rigid tab and the absence of a hinge formed therein greatly reduces the possibility of tab failure. Further, by providing a very long hinge line in comparison to hinge lines built into existing tabs, the chances of the tab being separated from the end unit during bending are minimized.

Also, the arrangement permits the rivet to be offset with respect to the scores or weakening lines so as to provide less interference with the score.

The arrangement also permits the rivet to be located closer to the nose of the tab, thereby providing a greater than customary mechanical advantage.

Although only a preferred embodiment of the invention has been specifically illustrated and described herein, it is to be understood that minor variations may be made in the easy opening container unit without departing from the spirit and scope of the invention as defined by the appended claims.

I claim:

1. An easy opening container unit comprising a container panel, a first line of weakness in said container panel defining a first displaceable panel portion for forming a dispensing opening, a second line of weakness in said container panel adjacent said first line of weakness defining a second displaceable panel portion permanently joined to said container panel along a second hinge line for forming a hinge panel, and an opening tab fixedly secured to said second displaceable panel portion for hinging therewith relative to said container panel and having means for applying a displacing pressure on said first displaceable panel portion.

2. A container unit according to claim 1 wherein said second line of weakness intersects said first line of weakness.

3. A container unit according to claim 1 wherein said second line of weakness intersects said first line of weakness, and said second hinge line extends from a free end of said second line of weakness remote from said first line of weakness to said first line of weakness in spaced relation to said intersection.

4. A container unit in accordance with claim 2 wherein said tab force applying means is an end of said tab overlying said first displaceable panel portion adjacent said intersection.

5. A container unit in accordance with claim 2 wherein said tab force applying means is an end of said tab overlying said first displaceable panel portion adjacent said intersection, and said first hinge line is on a side of said first displaceable panel portion remote from said intersection.

6. A container unit in accordance with claim 2 wherein said first displaceable panel portion has two remote sides, one of said sides being defined by an initially ruptureable portion of said first line of weakness and the other of said sides being in part defined by said first hinge line, and said intersection being along said one side.

7. A container unit in accordance with claim 6 wherein said tab force applying means is an end of said tab overlying said first displaceable panel portion adjacent said intersection and generally between said intersection and said first hinge line.

8. A container unit in accordance with claim 6 wherein said first displaceable panel portion has first and second ends, and said second hinge line extends between a free end of said second line of weakness and said second end.

9. A container unit in accordance with claim 6 wherein said first displaceable panel portion has first and second ends, and said second hinge line extends between a free end of said second line of weakness and said second end generally normal to an extension of said first hinge line.

10. A container unit in accordance with claim 9 wherein said tab force applying means is an end of said tab overlying said first displaceable panel portion adjacent said intersection.

11. A container unit according to claim 10 wherein said tab extends beyond said first displaceable panel portion at said second end.

12. A container unit according to claim 1 wherein said tab is rigid.

13. A container unit according to claim 1 wherein said tab force applying means is a generally triangular end including one side bridging said first and second displaceable panel portions.

14. A container unit according to claim 1 wherein said tab force applying means is a generally triangular end including one side bridging said first and second displaceable panel portions, and a second side extending generally longitudinally of said first displaceable panel portion.

15. A container unit according to claim 1 wherein said first displaceable panel portion is elongated and of a width materially less than its length.

16. A container unit according to claim 1 wherein said tab force applying means is a force applying nose overlying said first displaceable panel portion, and said tab is fixedly secured to said second displaceable panel portion intermediate said nose and said second hinge line.

17. A container unit according to claim 1 wherein said container panel is a circular end panel, said first displaceable panel portion is generally centered on a diametrical line, and one edge of said tab is disposed generally along said diametrical line.

18. A container unit according to claim 17 wherein said second hinge line is disposed along a second diametrical line normal to the first diametrical line.

19. A container unit in accordance with claim 1 wherein said container unit is a closed container intended to be in an upright position when opened, said container panel is part of a top of said container unit, a liquid product is packaged within said container unit, said liquid product has a fill level spaced below said container panel, said first displaceable panel portion is elongated and of a width materially less than its length, and said first displaceable panel portion width being generally commensurate with the spacing of said fill level below said container panel whereby during opening of said container unit said first displaceable panel will have minimum contact with said liquid product thereby minimizing liquid product foaming and gushing during said container unit opening.

* * * * *